US007802855B2

(12) United States Patent
Calmeise

(10) Patent No.: US 7,802,855 B2
(45) Date of Patent: Sep. 28, 2010

(54) HOME APPLIANCE HAVING A DOOR

(75) Inventor: Randall W. Calmeise, Louisville, KY (US)

(73) Assignee: General Electric Company, Schenectady, NY (US)

( * ) Notice: Subject to any disclaimer, the term of this patent is extended or adjusted under 35 U.S.C. 154(b) by 35 days.

(21) Appl. No.: 11/240,209

(22) Filed: Sep. 30, 2005

(65) Prior Publication Data

US 2007/0075614 A1 Apr. 5, 2007

(51) Int. Cl.
*A47B 95/02* (2006.01)
*F26B 11/02* (2006.01)

(52) U.S. Cl. ..... 312/228; 34/603

(58) Field of Classification Search ..... 312/228, 312/329, 326, 109; 68/3 R; 16/412, 419, 16/444; 49/460; 220/377, 212.5; 34/603; D32/6, 5

See application file for complete search history.

(56) References Cited

U.S. PATENT DOCUMENTS 946,317 A * 1/1910 Bassick et al. ..... 16/419
2,118,582 A * 5/1938 Zimarik ..... 68/139
2,317,213 A * 4/1943 Oliver ..... 220/849
2,587,645 A * 3/1952 O'Neil ..... 220/849
2,722,119 A * 11/1955 Constantine ..... 68/139
3,899,204 A 8/1975 Ulrich
4,934,559 A * 6/1990 Putnam ..... 220/377
5,195,647 A * 3/1993 Studt ..... 220/810
6,057,534 A * 5/2000 Lee ..... 219/739
D450,164 S * 11/2001 Dyson et al. ..... D32/6
D459,037 S * 6/2002 Schober ..... D32/6
D459,844 S * 7/2002 Baldwin et al. ..... D32/6
6,560,998 B2 * 5/2003 Wright ..... 68/139
D518,250 S * 3/2006 Kirk et al. ..... D32/6
D524,001 S * 6/2006 Carey et al. ..... D32/6
2003/0172689 A1 * 9/2003 Fitton et al. ..... 68/12.26
2004/0020246 A1 * 2/2004 Yun et al. ..... 68/24
2004/0089031 A1 5/2004 Kim et al.
2005/0262887 A1 12/2005 Kim et al.
2005/0268667 A1 * 12/2005 Yoon et al. ..... 68/3 R
2006/0265959 A1 * 11/2006 Renzo ..... 49/381
2007/0051012 A1 * 3/2007 Schoene ..... 34/603

* cited by examiner

*Primary Examiner*—James O Hansen
(74) *Attorney, Agent, or Firm*—George L. Rideout, Esq.; Armstrong Teasdale LLP

(57) ABSTRACT

A front face for an appliance that is one of a washing machine and a clothes dryer includes a door panel having a transparent window defined thereon, a door handle including a handle body having an inner surface, an outer surface, and two end portions. The handle is coupled to the door panel and is configured such that a portion of the handle does not contact the door panel and defines an opening between the inner surface of the handle body and the door panel.

11 Claims, 7 Drawing Sheets

HOME APPLIANCE HAVING A DOOR

BACKGROUND OF THE INVENTION

This invention relates generally to home appliances, and, more particularly, to a door and cabinet for a home appliance Some known home appliance, such as, but not limited to, horizontal axis washing machines, and clothes dryers typically include a cabinet defining an appliance cavity therein, and a door hingedly coupled to the cabinet for closing the appliance cavity. At least some known home appliances include a pocket-shaped handle mounted on the door for manipulating the door. The handle typically includes a side wall curving outward from the door which forms a one fourth sphere shaped space between the side wall and the door. An operator may insert a hand into the space of the handle, and grasp the side wall between fingers to hold the handle to move.

BRIEF DESCRIPTION OF THE INVENTION

In one aspect, a front face for an appliance is provided. The appliance is one of a washing machine and a clothes dryer. The front face includes a door panel having a transparent window defined thereon, a door handle including a handle body having an inner surface, an outer surface, and two end portions. The handle coupled to the door panel at only the end portions such that the door handle defines an opening between the inner surface of the handle body and the door panel. The front face having a convex end portion.

In another aspect, an appliance is provided that is one of a washing machine and a clothes dryer. The appliance includes a cabinet having a top panel, a bottom panel, a pair of side panels and a front face extending above the top panel. At least a portion of the front face being curved. The appliance also includes an appliance door hingedly coupled to the front face.

In another aspect, a method for assembling an appliance is provided. The method includes providing a cabinet having a top panel, a bottom panel, a pair of side panels and a front face. The front face extends above the top panel and is curved. The method further includes hingedly coupling an appliance door to the front face of the cabinet and coupling a handle to the door such that the handle contacts the door at only two locations.

DETAILED DESCRIPTION OF THE INVENTION

Figure 1:
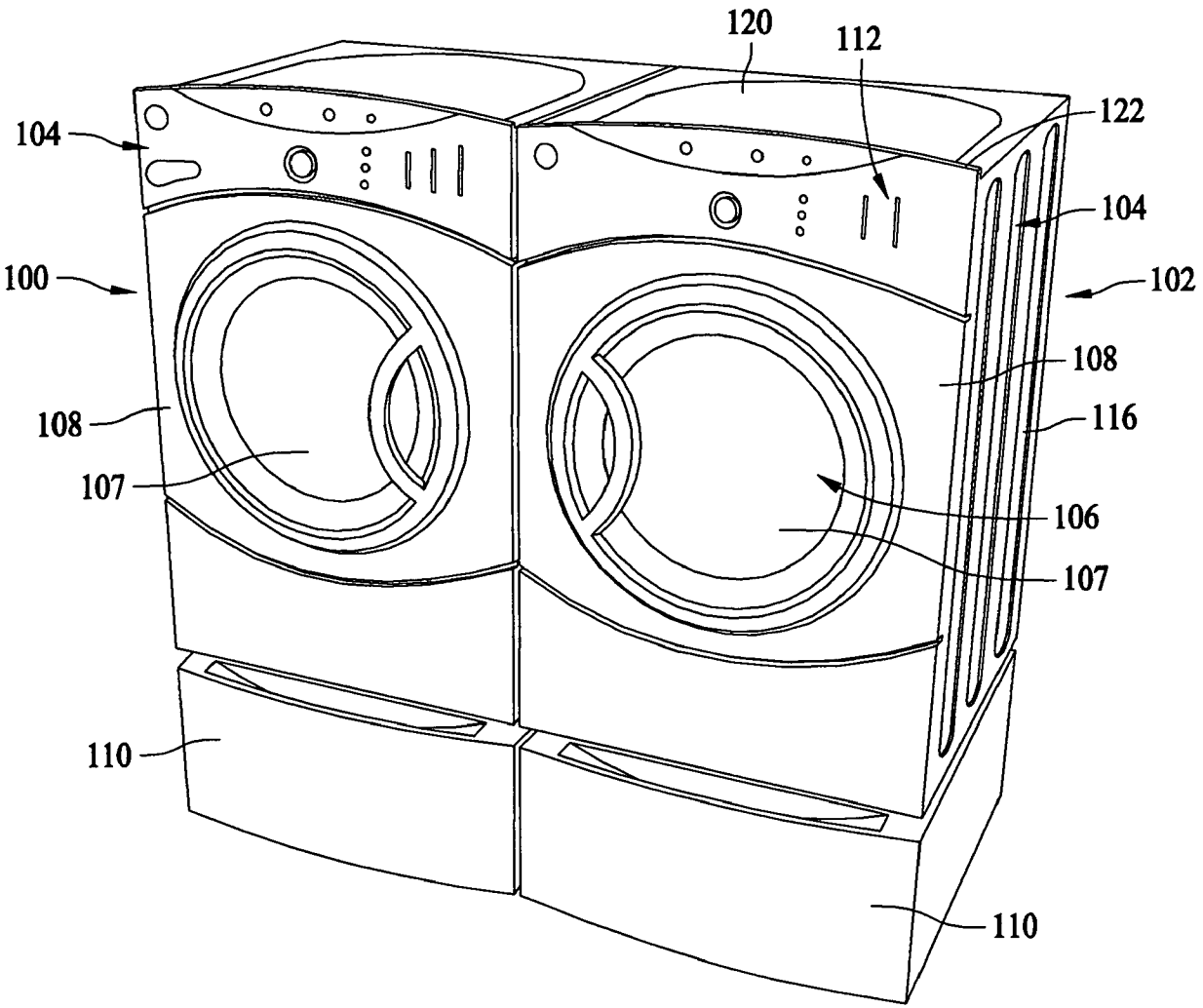
FIG. 1 is a perspective view of a washing machine and clothes dryer.

FIG. 1 illustrates a horizontal axis washing machine 100 and a clothes dryer 102 arranged side by side. However, it is appreciated that, the home appliances may also be stacked with respect to each other in alternative embodiments. Each home appliance 100, 102 includes a cabinet 104 defining an appliance cavity 106 therein, a clothes basket or drum 107 positioned within cavity 106, an appliance door 108 hingedly coupled to a door panel for closing appliance cavity 106, and a base unit 110 supporting cabinet 104 thereon.

It is contemplated that the present invention is applicable, not only to horizontal axis washing machines and clothes dryers, such as washing machine 100 and clothes dryer 102, but to other forms of home appliances as well. Therefore, washing machine 100 and clothes dryer 102 are provided by way of illustration rather than limitation. Accordingly, the following description is for illustrative purposes only, and is not intended to limit application of the present invention to any particular home appliance, such as washing machine 100 and clothes dryer 102.

In the exemplary embodiment, cabinet 104 includes a front face 112, a rear panel (shown in FIG. 2), a pair of side panels 116 spaced apart from each other by the rear panel, a bottom panel (shown in FIG. 2), and a top panel 120. In one embodiment, front face 112 curves outward and is convex with respect to top panel 120, i.e. front face 112 curves forward from cabinet 104. In another embodiment, front face 112 also curves upward. In an exemplary embodiment, front face 112 extends above top panel 120, which forms a ledge 122 on cabinet 104 configured to prevent items from rolling off of top panel 120.

Figure 2:
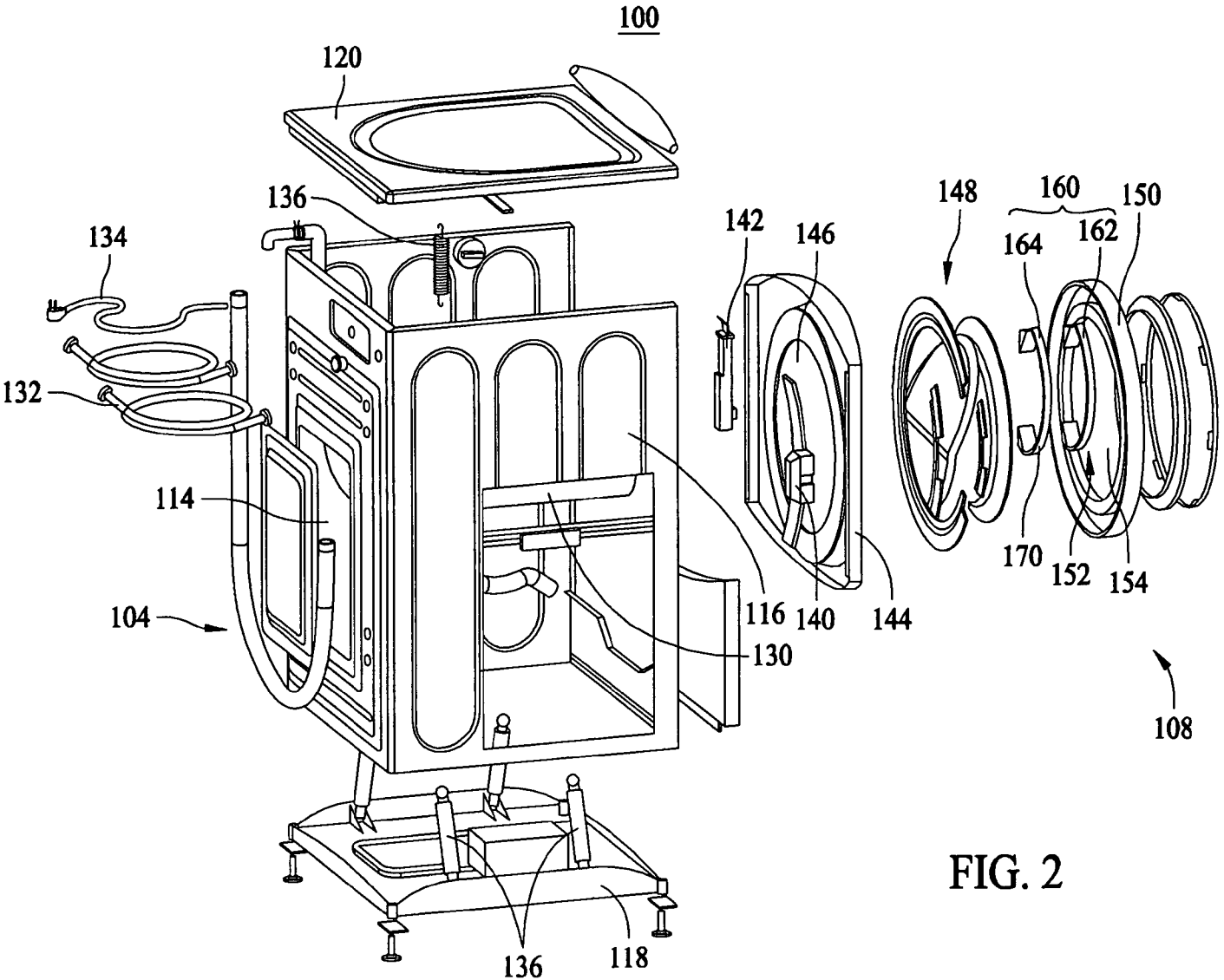
FIG. 2 is an exploded view of the washing machine shown in FIG. 1.

FIG. 2 is an exploded view of washing machine 100 further including a cylindrical wash tub 130 positioned within cabinets 104, and a motor (not shown) positioned within cabinet 104. Wash tub 130 receives basket 107 (shown in FIG. 1) rotatably mounted therein, for receiving clothing articles and other fabrics to be washed therein. The motor drives basket 107 to rotate around a substantially horizontal axis through a pulley wheel (not shown) and a belt (not shown).

In the exemplary embodiment, washing machine 100 includes a plurality of water pipes 132 and power lines 134 mounted on rear panel 114. Water pipes 132 are coupled in flow communication with wash tub 130 for channeling water into or out of wash tub 130. Power lines 134 are electrically connected with the motor (not shown) and other electrical components for providing electric power. Washing machine 100 also includes a plurality of spaced apart tub suspension elements 136, such as springs, mounted on top panel 120 or bottom panel 118, respectively. Each tub suspension element 136 is directly or indirectly attached to wash tub 130, such that wash tub 130 is suspended within cabinet 104.

In the exemplary embodiment, appliance door 108 is coupled to a door panel 144 and is hingedly coupled to front face 112 (shown in FIG. 1). Specifically, door 108 is coupled to door panel 144 through a hinge 140 mounted on door panel 144, and door 108 can be kept at the closed position by a latch 142 also mounted on door panel 144. Door panel 144 defines a circular opening 146 therein, a transparent window 148 mounted in opening 146, a door frame 150 surrounding window 148, and a door handle 152 mounted thereon.

In the exemplary embodiment, door panel 144 is substantially rectangular and curves forward from cabinet 104. Door frame 150 is substantially ring shaped, and defines a circular opening 154 in the center thereof. Opening 154 is substantially complementary in shape with respect to window 148 such that opening 154 facilitates observing the inside of appliance cavity 106 through window 148 and through the second window (180 shown in FIG. 3).

In the exemplary embodiment, door handle 152 includes an arc shaped handle body 160 connected to door frame 150. In one embodiment, handle body 160 includes a front half 162 integrally formed with door frame 150, and a rear half 164 coupled with front half 162 by screws. In another embodiment, handle body 160 is a one-piece component integrally formed with door frame 150. In a further embodiment, door handle 152 is attached to door frame 150 by screws, adhesive or other suitable methods known in the art. Alternatively, door handle 152 is positioned on door panel 144 apart from door frame 150.

Figure 3:
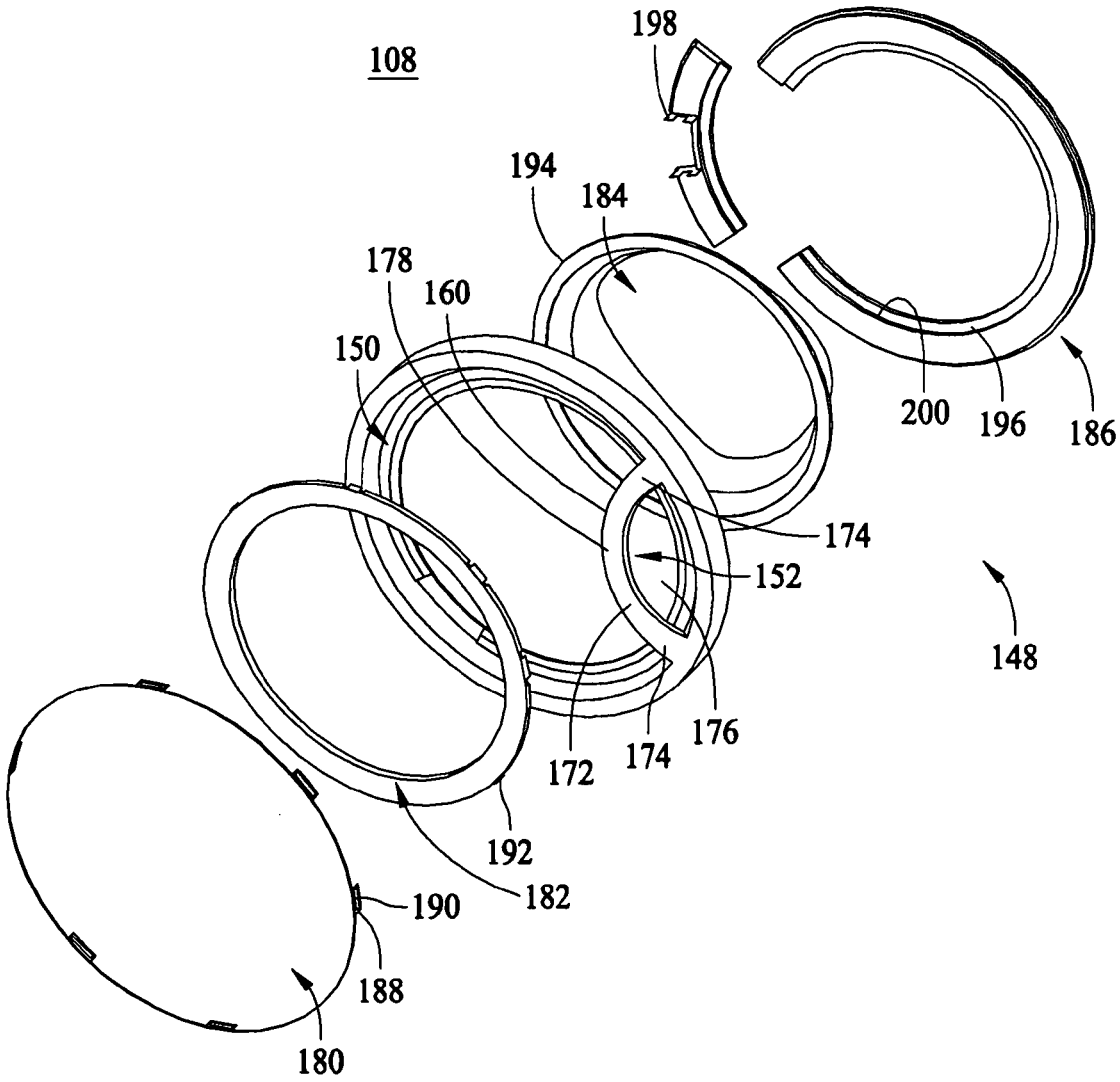
FIG. 3 is an exploded view of an appliance door applicable to the washing machine shown in FIGS. 1 and 2.

FIG. 3 is an exploded view of appliance door 108 applicable to home appliance 100 (shown in FIG. 2). Door panel 144 (shown in FIG. 2) is omitted from FIG. 3 for clarity. Handle body 160 includes an inner surface 170 (shown in FIG. 2) and an outer surface 172, and handle body 160 extends between two end portions 174. Door handle 152 is coupled to door panel 144 and door frame 150 only at end portions 174, such that door handle 152 defines an access opening 176 between inner surface 170 of handle body 160 and door panel 144.

In the exemplary embodiment, handle body 160 also includes a middle portion 178 connected with end portions 174. As illustrated in FIG. 3, handle body 160 curves toward an inside of door frame 150 as it extends from end portion 174 to middle portion 178. In one embodiment, handle body 160 also continuously extends away from door panel 144 (shown in FIG. 2) and door frame 150 between end portion 174 and middle portion 178. As such, the distance between inner surface 170 and door panel 144 gradually enlarges from end portion 174 to middle portion 178.

In the exemplary embodiment window 148 further includes a front glass portion 180, an inner ring 182, a rear glass portion 184, and a back cover 186. Front glass portion 180 is circular in shape, and includes a plurality of window latches 188 extending axially from a circumferential edge thereof. Window latches 188 are spaced apart from each other, and each window latch 188 further defines a groove 190 thereon. Inner ring 182 includes a plurality of tabs 192 radially extending outward from the outer edge thereof and is positioned corresponding to window latches 188 of front glass 180. Rear glass portion 184 is circular in shape, and includes a plurality of fastening edges 194 extending radially from a circumferential edge thereof. Back cover 186 includes a first element 196 and a second element 198 that engages with first element 196 to form an annulus receiving groove 200 therebetween. Groove 200 is substantially complementary in shape with fastening edge 194 of rear glass 184.

In assembling appliance door 108 (shown in FIG. 2), fastening edge 194 of rear glass portion 184 is received in receiving groove 200 formed by first and second elements 196, 198, such that back cover 186 maintains rear glass portion 184 thereon. Back cover 186 is then mounted onto door panel 144 (shown in FIG. 2), and rear glass portion 184 is positioned with respect to opening 146 of door panel 144. Tabs 192 of inner ring 182 are inserted into grooves 190 of latches 188, respectively, such that front glass portion 180 is retained on inner ring 182. Inner ring 182 is mounted onto a front surface of door frame 150, and door frame 150 is then mounted onto door panel 144 to surround rear glass portion 184. As such, appliance door 108 is assembled, and door handle 152 curves forward from door panel 144.

Figure 4:
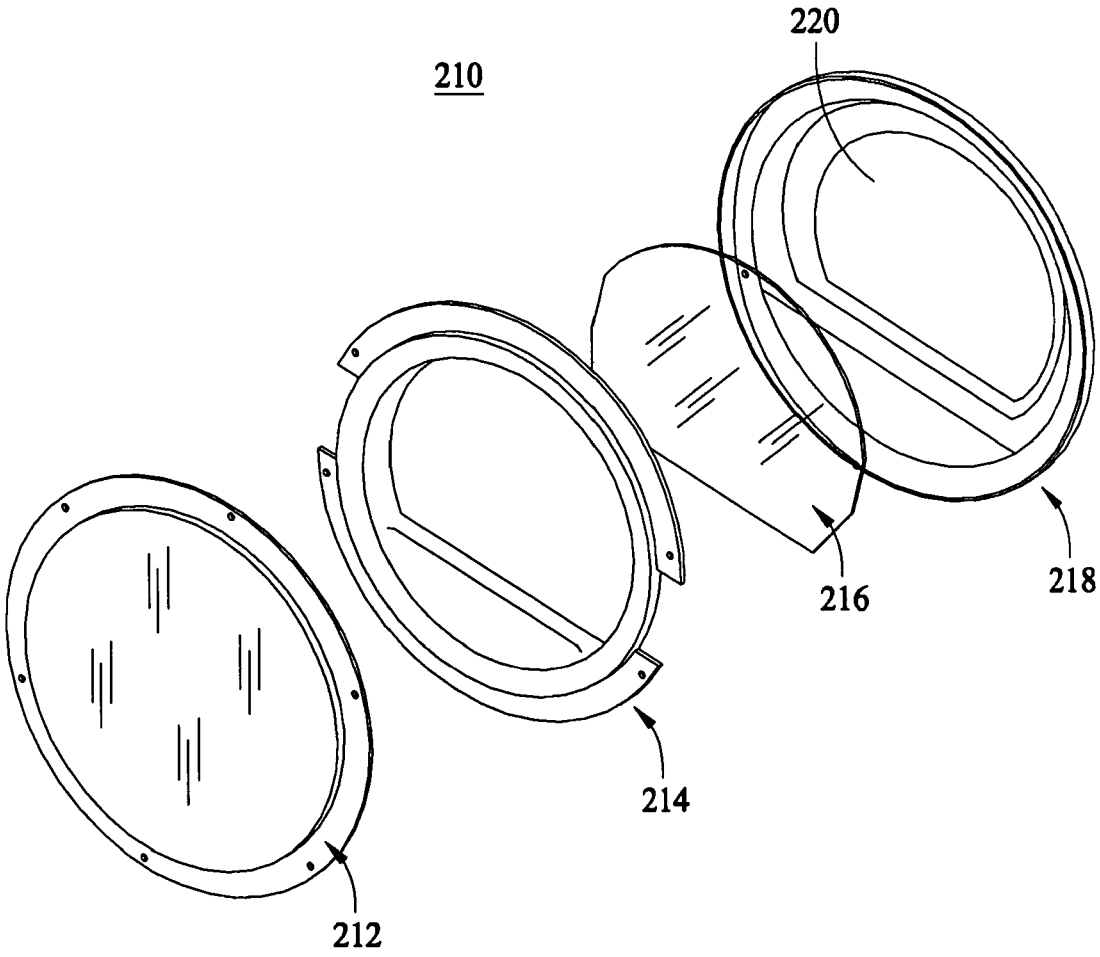
FIG. 4 is an exploded view of an alternative window applicable to the clothes dryer shown in FIGS. 1 and 2.

FIG. 4 is an exploded view of an alternative window 210 applicable to appliance door 108 shown in FIG. 2. In an exemplary embodiment, window 210 is utilized when appliance door 108 is used on a clothes dryer, such as for example, clothes dryer 102 (shown in FIG. 1). In this embodiment, window 210 is mounted to door frame 150 (shown in FIG. 3) and door panel 144 (shown in FIG. 2). It should be recognized, however, that the configuration and location of window 210 may be altered in alternative embodiments.

In the exemplary embodiment, window 210 includes a circular front glass portion 212, an inner ring 214, a rear glass portion 216, and a back cover 218. Inner ring 214 is configured to hold front glass portion 212, and can be mounted onto the front surface of door frame 150 (shown in FIG. 3). Rear glass portion 216 is substantially semicircular in shape. Back cover 218 defines an opening 220 substantially complementary in shape with rear glass portion 216. As such, back cover 218 maintains rear glass portion 216 thereon and is positioned to correspond with opening 220. Back cover 218, in one embodiment, is mounted to door panel 144 (shown in FIG. 2).

Figure 5:
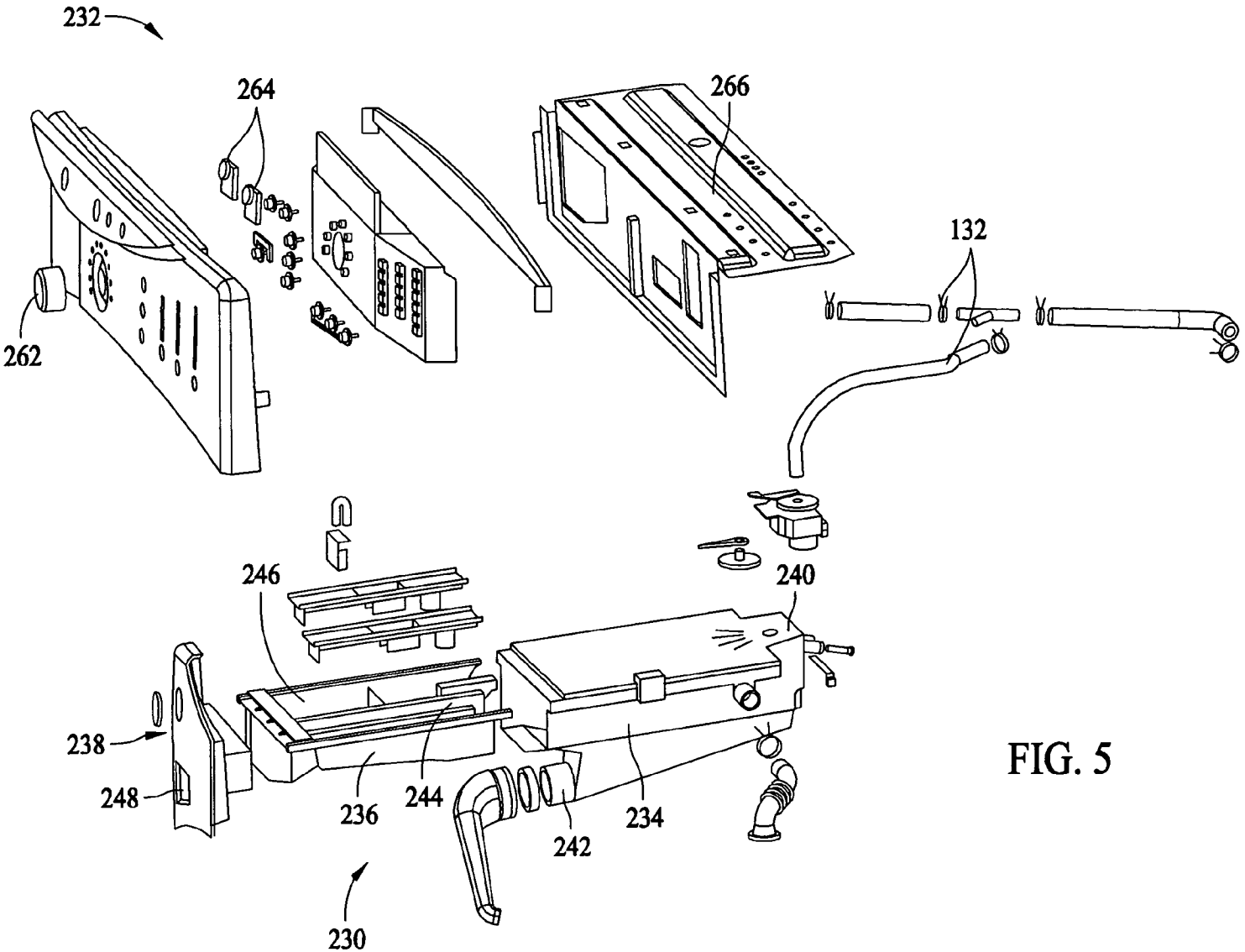
FIG. 5 is an exploded view of a dispenser and a control panel applicable to the washing machine shown in FIGS. 1 and 2.
Figure 6:
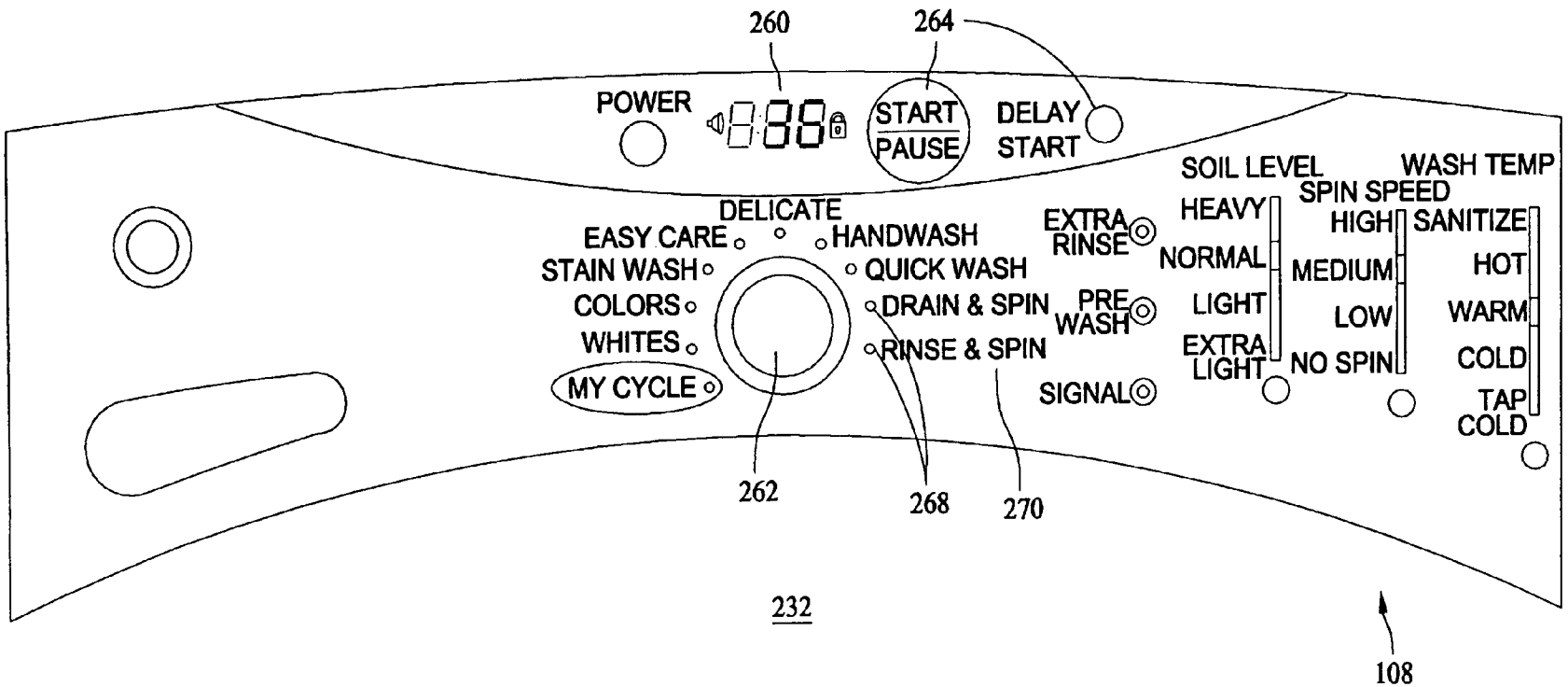
FIG. 6 is a front elevational view of the control panel shown in FIG. 5.

FIG. 5 is an exploded view of a dispenser 230 and a control panel 232 for inclusion on washing machine 100 shown in FIG. 2. FIG. 6 is a front view of control panel 232 shown in FIG. 5. Dispenser 230 is mounted on an upper left corner of front face 112, and includes an elongated dispenser base 234, a dispenser drawer 236 slidably received in dispenser base 234, and a dispenser panel 238 coupled to a front end of dispenser drawer 236.

In the exemplary embodiment, dispenser base 234 includes a water inlet 240 coupled in flow communication with water pipes 132, and a water outlet 242 coupled in flow communication with wash tub 130 (shown in FIG. 2). Dispenser drawer 236 includes a plurality of longitudinally extending partitioning walls 244 which divide dispenser drawer 236 into several separate compartments 246. Dispenser panel 238 defines a slot 248 therein which facilitates sliding dispenser drawer 236 out from and into dispenser base 234.

Compartments 246 of dispenser drawer 236 enable an operator to add different washing detergents and/or treating agents to different compartments 246 as desired when dispenser drawer 236 slides out. When dispenser drawer 236 slides into dispenser base 234, water is optionally channeled from water inlet 240 into the predetermined compartment 246 at the predetermined time upon the operator's selection, and any corresponding treating agent is automatically introduced into wash tub 130 through water outlet 242.

In the exemplary embodiment, control panel 232 is electrically connected with power lines 134 (shown in FIG. 2), and is coupled to a portion of front face 112 (shown in FIG. 2) which extends beyond top panel 120 (shown in FIG. 2). Control panel 232 includes a display 260, a rotatable knob 262, a plurality of input selectors 264, and a mounting bracket 266 for mounting control panel 232 onto cabinet 104.

In the exemplary embodiment, input selectors 264 are in the form of touch sensitive buttons, switches or keypads for accessing and selecting appliance features. It is contemplated that other known input selectors may be used in lieu of touch sensitive buttons in alternative embodiments. Control panel 232 includes a plurality of indicating elements 268, such as for example, indicating lamps positioned circumferentially around knob 262, and each indicating element 268 is associated with a corresponding home appliance feature. Control panel 232 also includes a plurality of signs 270 marked thereon and adjacent to indicating elements 268 for indicating the corresponding appliance features, respectively.

When rotating knob 262, the selected appliance feature changes from one to another, and the associated indicating element 268 lights to visually indicate the selected appliance feature. By manipulating the appropriate input selector 264 and rotatable knob 262, the appropriate feature or function is activated by an appliance controller (not shown) and, for most of the features, an icon or indicator is also displayed on display 260 to visually indicate selected appliance features and operating parameters, such as wash cycles, loading types, etc.

Figure 7:
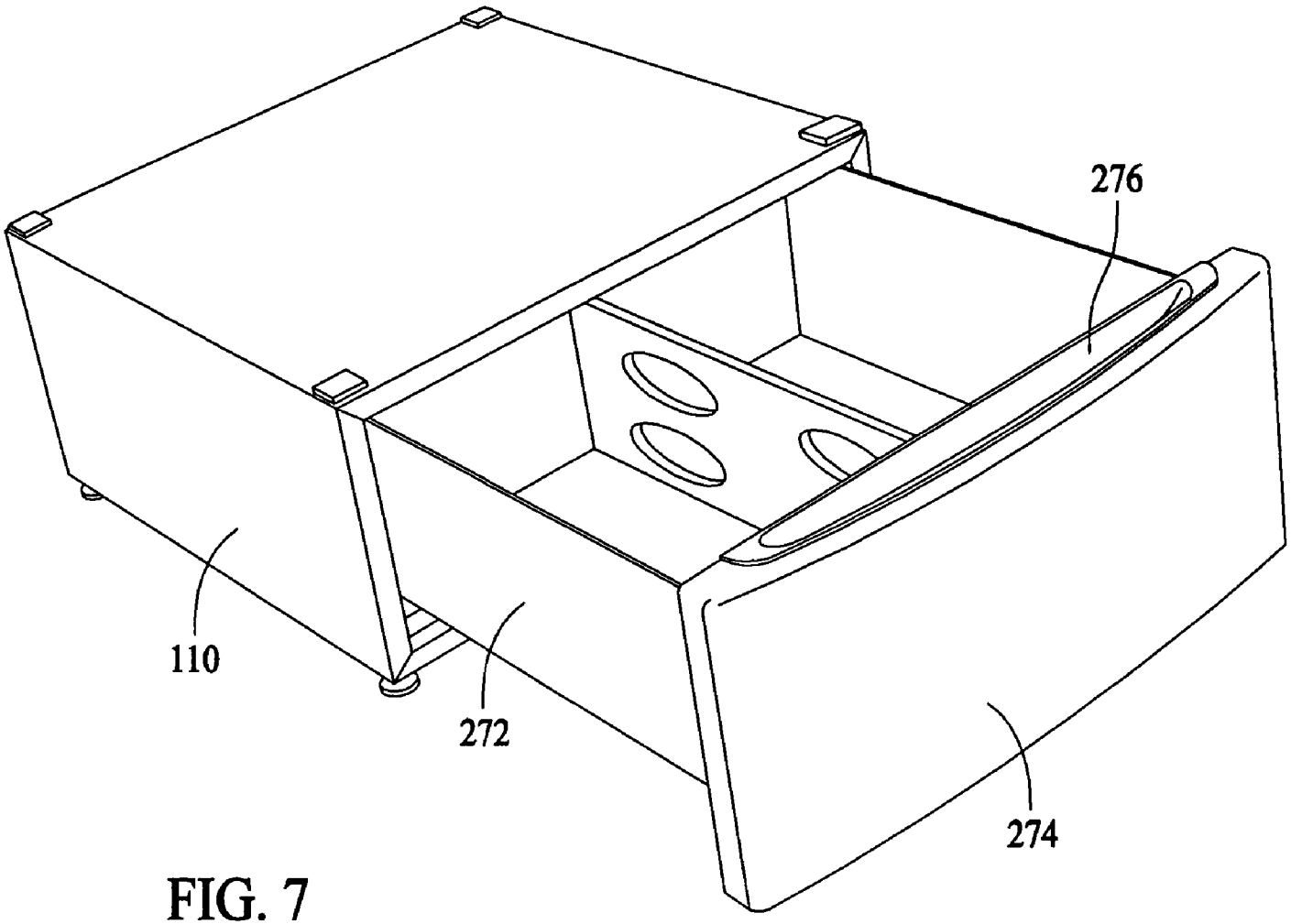
FIG. 7 is a perspective view of a base unit applicable to the washer and clothes dryer shown in FIG. 1.

FIG. 7 is a perspective view of base unit 110 applicable to the home appliances shown in FIG. 1. Base unit 110 is typically positioned below the home appliance, and includes a storage drawer 272 slidably mounted therein, and a drawer panel 274 coupled to a front end of storage drawer 272. Drawer panel 274 further defines a holding slot 276 defined substantially vertically thereon. Holding slot 276 facilitates manipulating drawer 272 sliding into and out of base unit 110.

Referring back to FIGS. 1 and 2, front face 112 curves upward and beyond top panel 120 to form ledge 122, which facilitates preventing items positioned on top panel 120 from falling off. In addition, an access opening 176 of door handle 152 enables an operator's hand to extend between inner surface 170 and door panel 144, and enables the hand to surround door handle 152. As such, any finger nails of the hand do not contact the door handle 152.

While the invention has been described in terms of various specific embodiments, those skilled in the art will recognize that the invention can be practiced with modification within the spirit and scope of the claims.

What is claimed is:

1. A front face for an appliance comprising one of a washing machine and a clothes dryer, said front face comprising:

a door panel defining a first opening for accessing an interior of the one of the washing machine and the clothes dryer;

a door frame coupled to said door panel, said door frame defining a second opening aligned with and complementary in shape to said first opening, a center of said door frame at a center of the second opening, a radius of said door frame extending from the center of said door frame;

a first transparent window mounted within said second opening, said first transparent window enabling viewing of the interior of the one of the washing machine and the clothes dryer; and a door handle comprising a handle body having an inner surface, an outer surface, a front surface, a rear surface, and two end portions, a first portion of said door handle formed integrally as one piece with said door frame and extending between said two end portions and a second portion coupled to said first portion to form said handle body, said handle body extending radially inwardly with respect to the radius of said door frame from said two end portions toward a mid point of said handle body such that said handle body is adjacent to and overlapping said first transparent window, said handle body defining an access opening between said inner surface of said handle body and said door frame.

2. A front face in accordance with claim 1 wherein said middle portion extends between said end portions, a distance between said inner surface and said door panel enlarging from said end portions to said middle portion.

3. A front face in accordance with claim 1 wherein said door frame further comprises a substantially annular door frame mounted on said door panel and surrounding said window.

4. A front face in accordance with claim 3 wherein said two end portions are proximate each other with respect to said substantially annular door frame, and said door handle curves radially inward from said door frame and extends between said two end portions.

5. A front face in accordance with claim 1 further comprising a convex end portion.

6. A front face in accordance with claim 1 wherein said handle body has an arcuate shape between said two end portions such that a distance between said inner surface of said handle body and said door frame increases from each end portion of said two end portions toward said mid point of said handle body.

7. A front face in accordance with claim 1 further comprising a ledge coupled with respect to a first edge of a top panel of the appliance, said ledge extending upwardly with respect to the top panel and configured to facilitate retaining items positioned on the top panel.

8. A front face in accordance with claim 1 further comprising a second transparent window, said first transparent window coupled adjacent to a front surface of said door frame and said second transparent window coupled adjacent to a rear surface of said door frame.

9. A front face in accordance with claim 8 further comprising an inner ring coupling said first transparent window to said front surface of said door frame.

10. A front face in accordance with claim 8 further comprising a back cover coupling said second transparent window to said rear surface by positioning said second transparent window within a groove defined in said back cover.

11. A front face in accordance with claim 1 wherein said second portion of said door handle is coupled to said first portion such that said second portion is adjacent said first transparent window, said second portion positioned completely over said first transparent window.

* * * * *